US007683292B2

(12) United States Patent
Cavada et al.

(10) Patent No.: US 7,683,292 B2
(45) Date of Patent: Mar. 23, 2010

(54) METHOD FOR COOKING A FOOD WITH INFRARED RADIANT HEAT

(75) Inventors: Luis Cavada, Miami, FL (US); Alvaro Vallejo Noriega, Querétaro (MX)

(73) Assignee: Applica Consumer Products, Inc., Miramar, FL (US)

( * ) Notice: Subject to any disclaimer, the term of this patent is extended or adjusted under 35 U.S.C. 154(b) by 309 days.

(21) Appl. No.: 11/869,359

(22) Filed: Oct. 9, 2007

(65) Prior Publication Data

US 2008/0029503 A1 Feb. 7, 2008

Related U.S. Application Data

(62) Division of application No. 10/776,028, filed on Feb. 10, 2004, now Pat. No. 7,323,663.

(51) Int. Cl.
*A21B 1/00* (2006.01)
*F21V 9/00* (2006.01)

(52) U.S. Cl. ..... 219/411; 219/391; 219/396; 219/397; 219/405; 392/408; 392/411; 392/416; 392/425; 250/495.1; 250/504 R

(58) Field of Classification Search ..... 219/411, 219/391, 396, 397, 405; 392/408, 411, 416, 392/425; 250/495.1, 504 R
See application file for complete search history.

(56) References Cited

U.S. PATENT DOCUMENTS

| | | | | |
|---|---|---|---|---|
| 3,472,153 A | 10/1969 | Arntz | ..... | 99/329 |
| 3,604,338 A | 9/1971 | Fiedler | ..... | 99/339 |
| 3,626,154 A | 12/1971 | Reed | ..... | 219/411 |
| 3,646,879 A | 3/1972 | Palmason et al. | ..... | 99/339 |
| 3,663,798 A | 5/1972 | Speidel et al. | ..... | 219/464 |
| 3,668,371 A | 6/1972 | Fry et al. | ..... | 219/413 |

(Continued)

FOREIGN PATENT DOCUMENTS

EP 0696430 A1 2/1996

(Continued)

OTHER PUBLICATIONS

Lightwave Oven, Use and Care Guide and Recipe Book Models TLWTOB6 and TLWTOB6CAN, Toastmaster, 27 pages, 2004.

(Continued)

*Primary Examiner*—Shawntina Fuqua
(74) *Attorney, Agent, or Firm*—King & Spalding L.L.P.

(57) ABSTRACT

An oven using radiant heat at infrared wavelengths optimized for producing rapid and uniform cooking of a wide variety of foods. The infrared oven toasts, bakes, broils, and reheats food at a much faster speed while maintaining high quality in taste and appearance of the cooked food. Optimal infrared wavelengths of the radiant heat sources are used for the best balance of cooking performance, while also reducing the time required to cook the food. Typically short to medium wavelength infrared radiant energy will result in good performance for toasting and browning of food. Medium to long wavelength infrared radiant energy is well suited for delivering more deeply penetrating radiant energy into the food. This deep penetration of radiant infrared heat energy results in a more thorough internal cooking of the food than with conventional methods of conduction and convection cooking.

21 Claims, 5 Drawing Sheets

U.S. PATENT DOCUMENTS 3,736,860 A 6/1973 Vischer, Jr. ..... 99/339
3,941,044 A 3/1976 Goltsos ..... 99/391
3,978,238 A 8/1976 Frey et al. ..... 425/523
4,093,841 A 6/1978 Dills ..... 219/10.55
4,135,077 A 1/1979 Wills
4,150,609 A 4/1979 McClean ..... 99/372
4,164,644 A 8/1979 Remsnyder et al. ..... 219/433
4,345,143 A 8/1982 Craig et al. ..... 219/411
4,421,015 A 12/1983 Masters et al. ..... 99/332
4,441,002 A 4/1984 Teich et al. ..... 219/10.55
4,481,404 A 11/1984 Thomas et al. ..... 219/398
4,489,234 A 12/1984 Harnden, Jr. et al. ..... 219/347
4,491,066 A 1/1985 Juriga et al. ..... 99/391
4,516,486 A 5/1985 Burkhart ..... 99/388
4,551,616 A 11/1985 Buttery ..... 219/460
4,554,437 A 11/1985 Wagner et al. ..... 219/388
4,575,616 A 3/1986 Bergendal ..... 219/405
4,577,092 A 3/1986 Lenoir ..... 219/354
4,580,025 A 4/1986 Carlson et al. ..... 219/10.55
4,602,143 A 7/1986 Mack et al. ..... 219/225
4,664,923 A 5/1987 Wagner et al. ..... 426/233
4,728,777 A 3/1988 Tsisios et al. ..... 219/348
4,761,529 A 8/1988 Tsisios ..... 219/10.55
4,791,862 A 12/1988 Hoffmann ..... 99/385
4,889,042 A 12/1989 Hantz et al. ..... 99/340
4,960,977 A 10/1990 Alden ..... 219/388
4,965,434 A 10/1990 Nomura et al. ..... 392/407
4,972,768 A 11/1990 Basora San Juan ..... 99/391
5,033,366 A 7/1991 Sullivan ..... 99/352
5,036,179 A 7/1991 Westerberg et al. ..... 219/411
5,126,534 A 6/1992 Kwong ..... 219/219
5,157,239 A 10/1992 Kanaya et al. ..... 219/411
5,181,455 A 1/1993 Masel et al. ..... 99/391
5,223,290 A 6/1993 Alden ..... 426/243
5,237,913 A 8/1993 Hahnewald et al. ..... 94/389
5,266,766 A 11/1993 Hecox ..... 219/10.81
5,317,134 A 5/1994 Edamura ..... 219/720
5,363,748 A 11/1994 Boehm et al. ..... 99/372
5,378,872 A 1/1995 Jovanovic ..... 219/388
5,382,441 A 1/1995 Lentz et al. ..... 426/241
5,390,588 A 2/1995 Krasznai et al. ..... 99/389
5,400,697 A 3/1995 Dax et al. ..... 99/389
5,404,420 A 4/1995 Song ..... 392/416
5,471,914 A 12/1995 Krasznai et al. ..... 99/389
5,472,721 A 12/1995 Eisenberg et al. ..... 426/243
5,499,574 A 3/1996 Esposito ..... 99/339
5,517,005 A 5/1996 Westerberg et al. ..... 219/685
5,560,285 A 10/1996 Moreth ..... 99/421 H
5,590,584 A 1/1997 Ahn ..... 99/327
5,606,905 A 3/1997 Boehm et al. ..... 99/375
5,647,270 A 7/1997 Rousseau et al. ..... 99/327
5,653,158 A 8/1997 Balandier et al. ..... 99/327
5,676,870 A 10/1997 Wassman et al. ..... 219/400
5,692,432 A 12/1997 Hazan et al. ..... 99/328
5,726,423 A 3/1998 Westerberg et al. ..... 219/411
5,771,780 A 6/1998 Basora et al. ..... 99/327
5,793,019 A 8/1998 Boyle et al. ..... 219/400
5,809,994 A 9/1998 Maher, Jr. ..... 126/374
5,823,099 A 10/1998 Ko ..... 99/446
5,877,477 A 3/1999 Petty et al. ..... 219/506
5,905,269 A 5/1999 Venkataramani et al. 250/504 R
5,909,533 A 6/1999 Kitabayashi et al. ..... 392/310
5,924,355 A 7/1999 Belknap et al. ..... 99/389
5,947,006 A 9/1999 Mauffrey ..... 99/327
5,958,271 A 9/1999 Westerberg et al. ..... 219/413
5,960,702 A 10/1999 Thiriat et al. ..... 99/327
5,990,454 A 11/1999 Westerberg et al. ..... 219/411
6,011,242 A 1/2000 Westerberg ..... 219/411
6,013,900 A 1/2000 Westerberg et al. ..... 219/405
6,013,908 A 1/2000 Kume et al. ..... 219/719
6,018,146 A 1/2000 Uzgiris et al. ..... 219/405
6,057,528 A 5/2000 Cook ..... 219/405
6,062,128 A 5/2000 Borgward ..... 99/326
6,069,345 A 5/2000 Westerberg ..... 219/411
RE36,724 E 6/2000 Westerberg et al. ..... 219/685
6,097,016 A 8/2000 Hirata et al. ..... 219/720
6,146,677 A 11/2000 Moreth ..... 426/505
6,172,347 B1 1/2001 Lee ..... 219/685
6,201,217 B1 3/2001 Moon et al. ..... 219/386
6,229,117 B1 5/2001 Lenahan ..... 219/411
6,250,210 B1 6/2001 Moreth ..... 99/331
6,294,769 B1 9/2001 McCarter ..... 219/544
6,297,481 B1 10/2001 Gordon ..... 219/406
6,297,485 B1 10/2001 Kim et al. ..... 219/680
6,307,185 B1 10/2001 Loveless ..... 219/400
6,311,608 B1 11/2001 Hardin et al. ..... 99/326
6,316,757 B1 11/2001 Kim et al. ..... 219/680
6,320,165 B1 11/2001 Ovadia ..... 219/400
6,348,676 B2 2/2002 Kim et al. ..... 219/411
6,369,360 B1 4/2002 Cook ..... 219/388
6,369,366 B1 4/2002 Mullen ..... 219/450.1
6,382,084 B2 5/2002 Chan et al. ..... 99/327
6,405,640 B1 6/2002 Moreth ..... 99/334
6,408,842 B1 6/2002 Herrera ..... 126/41 C
6,415,710 B1 7/2002 Boone ..... 99/446
6,429,409 B1 8/2002 Siu ..... 219/450.1
6,448,540 B1 9/2002 Braunisch et al. ..... 219/685
6,486,453 B1 11/2002 Bales et al. ..... 219/702
6,528,772 B1 3/2003 Graves et al. ..... 219/680
6,530,309 B2 3/2003 Van Der Meer et al. ..... 99/331
6,600,138 B2 7/2003 Hauf et al. ..... 219/411
6,649,877 B1 11/2003 Mauffrey et al. ..... 219/386
6,654,549 B1 11/2003 Konishi ..... 392/407
6,670,586 B2 12/2003 Ingemanson et al. ..... 219/492
6,707,011 B2 3/2004 Tay et al. ..... 219/411
6,717,110 B2 4/2004 Van der Meer et al. ..... 219/386
6,900,423 B2 5/2005 Chun ..... 219/702
6,922,017 B2 7/2005 Konishi et al. ..... 313/623
6,933,477 B2 8/2005 Becker et al. ..... 219/506
6,964,222 B1 11/2005 Tucker ..... 99/281
7,013,798 B2 3/2006 Arnedo et al. ..... 99/326
7,109,442 B2 9/2006 Steinberg et al. ..... 219/386
7,267,597 B2 9/2007 Konishi et al. ..... 445/27
2002/0092842 A1 7/2002 Loveless ..... 219/400
2002/0144995 A1 10/2002 Chun ..... 219/720
2004/0131493 A1 7/2004 Hattendorf et al. ..... 420/62
2005/0005776 A1 1/2005 Steinberg et al. ..... 99/331
2005/0005777 A1 1/2005 Steinberg et al. ..... 99/349
2005/0173400 A1 8/2005 Cavada et al. ..... 219/411
2005/0218139 A1 10/2005 Cavada et al. ..... 219/720
2005/0247210 A1 11/2005 Ragan ..... 99/372

FOREIGN PATENT DOCUMENTS

JP 200055376 A 2/2000
JP 2000055376 A 2/2000

OTHER PUBLICATIONS

Toastmaster® Dealer Price List, Jan. 1, 2003, 1 page, Jan. 1, 2003.
Toastmaster® Spring Program 2003, 1 page, 2003.
George Foreman, The Next Grilleration Model No. GRP99 Owner's Manual, Salton, Inc., pp. 1-12, 2004.
Appliance Heating Alloys, Kanthal Handbook, The Kanthal Corporation, pp. 4-38, 1997.
New High Temperature Quartz Heater Provides Efficiency, Economy, Watlow Electric Manufacturing Company, 3 pages, 2001.
Toaster Oven Instruction Manuel, www.krups.com, Krups USA 196 Boston Ave., Medford, MA 02155, 16 pages, 2004.
Computer Generated Translation of JP2000055376A; provided by Examiner in Jan. 29, 2007 Office Action of U.S. Appl. No. 10/776,028 (with Examiner notes); 6 pages, Jan. 10, 2007.

METHOD FOR COOKING A FOOD WITH INFRARED RADIANT HEAT

RELATED APPLICATION

This application is a divisional of U.S. patent application Ser. No. 10/776,028 filed Feb. 10, 2004 now U.S. Pat. No. 7,323,663, the contents of which is hereby incorporated in its entirety by reference.

BACKGROUND OF THE INVENTION TECHNOLOGY

1. Field of the Invention

The present invention relates to electric ovens, and more specifically, to an infrared heated electric oven having reduced cooking time and improved browning consistency.

2. Background of the Related Technology

Over the years there have been many attempts at finding ways to speed up cooking. Products such as convection, microwave, and infrared ovens have been devised in order to try and speed up the cooking process. With present day ovens, there were usually some tradeoffs the consumer had to accept in order to gain faster cooking speeds. Usually cooking quality would be sacrificed in favor of speed. This is why microwave ovens for warming and cooking of foods have made such a significant penetration in to the home. There is a significant gain in speed using microwave cooking, however, the cooked food quality is very poor. Heretofore, consumers have been willing to consume poorer quality prepared foods in order to enjoy the faster warming and/or cooking time. Unfortunately foods cooked in a microwave oven have substantially all of their moisture evaporated by the microwaves and thus suffer from a lack taste. For other cooking technologies like convection and infrared, consumers were forced to accept minimal speed increase with the convection ovens, and very limited cooking quality and time improvements with the infrared ovens. Infrared ovens perform faster when cooking frozen pizzas and toasting bread, however, the infrared ovens lacked in achieving good quality and speed in other cooking tasks.

Therefore, a problem exists, and a solution is required for improving the speed and quality of cooking food with infrared radiant heat.

SUMMARY OF THE INVENTION

The invention remedies the shortcomings of current infrared oven cooking technologies by providing an infrared oven using radiant heat at infrared wavelengths optimized for producing rapid and uniform cooking of a wide variety of foods. The infrared oven disclosed herein can toast, bake, broil, and re-heat food at a much faster speed while maintaining high quality in taste and appearance of the cooked food. The present invention utilizes substantially optimal infrared wavelengths of the radiant heat sources, resulting in a good balance of short, medium and long wavelength infrared radiant heat for the best balance of cooking performance, while also reducing the time required to cook the food.

Typically short to medium wavelength infrared radiant energy will result in good performance for toasting and browning of food. Medium to long wavelength infrared radiant energy are well suited for delivering more deeply penetrating radiant energy into the food. This deep penetration of radiant infrared heat energy results in a more thorough internal cooking of the food than with conventional methods of conduction and convection cooking.

It is contemplated and within the scope of the invention that selected infrared wavelengths of the radiated heat may be used to effectively defrost the food without adding significantly to the time required to fully cook the food.

The invention may emit a plurality of infrared wavelengths of radiated heat, wherein the plurality of infrared wavelengths are selected for optimal heat penetration and surface browning of the food. Shorter wavelengths for browning and slightly longer wavelengths to penetrate the food for evaporating the moisture therein to allow surface browning by the shorter wavelengths. In addition, the heating energy within the oven may be further elongated (longer wavelengths) once the infrared radiation is re-radiated off of reflectors within the oven. According to the invention, the internal reflectors facilitate substantially even distribution of the infrared energy throughout the oven cooking chamber so as to maximize the radiant heat coverage of the food being cooked.

Infrared heaters may be selected for the food type to be cooked. The selection of preferred infrared wavelengths may be determined by the absorption of these wavelengths by the foods being cooked. The more absorption of the infrared radiant energy, the greater the internal heating of the food being cooked and thus cooking taking place. However, the less the penetration (absorption) of the infrared radiant heat, the better the top browning of the food being cooked without excessively drying out the internal portion of the food being cooked. Therefore, slightly shorter wavelengths preferably may be selected for the top heater(s) than the lower heater(s) in the oven cooking chamber. The top heater(s) may preferably have a peak emission at a wavelength of from about 1.63 microns to about 1.7 microns (1630-1700 nm). The bottom heater(s) preferably may have a peak emission at a wavelength of from about 2.0 microns to about 2.2 microns (2000-2200 nm). Both top and bottom heaters may also radiate some infrared energy at some percentage of infrared wavelengths that are lower and higher than the preferred nominal infrared wavelengths. In addition to the wavelengths of the directly emitted infrared energy, the wavelengths of the reflected infrared energy may be further elongated once they have been reflected off the walls of the oven cooking chamber and the reflectors therein. It is contemplated and within the scope of the invention that radiant heaters that emit longer infrared wavelengths may be incorporated for improved cooking performance when baking and broiling of foods.

According to exemplary embodiments of the invention, the infrared wavelength radiation emitting heaters may be cylindrical and may comprise any type of material that can be used for resistance heating and is capable of emitting heating energy at infrared wavelengths, e.g. metal alloy filament materials such as, for example but not limited to, Ni Fe, Ni Cr, Ni Cr Fe and Fe Cr Al, where the symbols: Ni represents nickel, Fe represents iron, Cr represents chromium, and Al represents aluminum. The infrared wavelength emitting filament material may either be exposed or preferably enclosed within a high temperature infrared wavelength transparent tube, such as for example, a high temperature quartz tube, e.g., 99.9 percent pure quartz ($SiO_2$), and may be clear, chemically etched, or have extruded grooves therein depending upon the desired infrared wavelength(s) to be emitted. Tungsten may be used for the filament when enclosed in a sealed tube. The filament material may be heated by an electric current, alternating or direct, to a temperature sufficient for the emission of energy at a desired infrared wavelength(s). The infrared wavelength(s) emitted from the heater may be changed by changing the voltage applied to the filament material, and/or by changing the operating temperature of the heater filament.

Some of the infrared wavelength energy may be directed toward the surface of the food from heat reflectors located behind the infrared wavelength energy emitter (source). The heat reflectors may be designed so as to evenly distribute the infrared wavelength energy over the surface of the food for consistent browning thereof. The emitted infrared wavelengths that are radiated directly onto the surface of the food being cooked may be selected for optimal browning of the food, and the infrared energy reflected by the heat reflectors may be at longer infrared wavelengths than the wavelength(s) of the directly radiated infrared energy. The longer wavelength infrared energy will penetrate deeper into the food to aid in cooking thereof. The heat reflectors may be fabricated from aluminized steel, bright chrome plated metal and the like.

A gold coating, which is a very efficient reflector of infrared wavelengths, may also be placed over a portion of the quartz tube of the heater. This gold coating may be used to direct infrared wavelength energy as desired, e.g., toward the surface of the food, and reduce the amount of infrared wavelength energy from the side of the quartz tube opposite the surface of the food. Thus the gold coating will substantially reduce the infrared wavelength radiation in directions that are not useful for heating, browning and toasting of the food. In addition, the gold coating helps reduce the temperature of surfaces behind the gold coating, e.g., facing the oven housing surfaces, the metallic housing of the oven may be cool to the touch. The gold coating may be of any thickness, preferably about one micron in thickness.

Typical conduction and convection ovens rely on first heating up the air and chamber to a required temperature before the food is put into the oven for cooking. This creates an inefficient use of energy, a loss of time waiting for the oven to preheat, and causes unnecessary heating of the area surrounding the oven. According to the invention infrared oven, cooking begins immediately once the food is placed inside of the oven and the infrared heaters are turned on. A substantial amount of the infrared radiant heat is directed to cooking the food and does not unnecessary heat the air in the cooking chamber, thus reducing unwanted heat from the invention infrared oven and subsequent unnecessary heating of the surrounding areas proximate to the infrared oven.

According to an exemplary embodiment of the invention, an infrared oven comprises a cooking chamber adapted to receive food to be warmed, cooked, broiled, grilled, baked, toasted, etc., infrared wavelength emitting radiant heat sources located inside of the cooking chamber and placed above and below where the food is to be cooked, and heat reflectors located adjacent to the infrared wavelength emitting radiant heat sources and adapted to direct the infrared radiant heat toward the food to be cooked. The oven may also include a shelf, rack, tray, etc., in the cooking chamber on which food, e.g., in a pan, tray, dish, bowl, container, etc., may be supported. A grilling plate may be used on or with the tray for broiling or grilling of the food. In addition the infrared oven may be adapted for a rotisserie. An enclosure surrounds the cooking chamber, infrared wavelength radiant heat sources and heat reflectors. Controls for the oven may also be attached to the enclosure, and/or be an integral part thereof.

The infrared oven preferably may have one infrared heater located in a top portion of the cooking chamber, hereinafter "top heater," and two infrared heaters located in a bottom portion of the cooking chamber, hereinafter "bottom heaters." The top heater may be rated at about 900 to 1000 watts and the two bottom heaters rated at about 500 to 600 watts total. The combined total wattage of the top and bottom heaters preferably is about 1500 to 1600 watts. 1600 watts is within the continuous duty rating of a standard 20 ampere, 120 volt kitchen receptacle, pursuant to the National Electrical Code. Thus, no special wiring or receptacle is required for the oven to be used in a typical home or office kitchen. The top heater is preferably short to medium wavelength infrared. The bottom heaters are preferably medium wavelength. Once the radiation of the bottom heaters is re-radiated from the oven walls, the wavelengths of the re-radiated infrared energy become more like medium to long infrared wavelengths. It is contemplated and with in the scope of the oven invention that the top and bottom heaters may be on at different times or sometimes on simultaneously together. This independent pulsing or patterns of on and off times for the top and bottom infrared heaters allow great flexibility on how the infrared oven invention can influence the cooking speed and quality of the food being cooked. This allows the invention infrared oven to optimally toast and brown food, have good performance for cooking. There is no known product on the market that can optimally toast, bake, broil, and re-heat food using only one oven appliance.

A technical advantage of the present invention is appropriate selection of short, medium and long wavelengths of infrared energy so as to deliver a good balance of cooking performance and quality, while increasing the speed in which the food is cooked. Another technical advantage is more efficient use of power in cooking food. Yet another advantage is using a standard kitchen electrical outlet to power an infrared oven having increased cooking speed and cooking quality. Still another technical advantage is the food begins cooking immediately once it is placed in the cooking chamber. Another technical advantage is influencing the cooking speed and quality of the food being cooked by independently controlling the on and off times of the top and bottom infrared heaters. Another technical advantage is having a plurality of heaters such that at least one of the heaters emits a different infrared wavelength than the other heaters. Still another technical advantage is controlling the on and off times of the heaters where at least one of the heaters emits a different infrared wavelength than the other heaters so that the infrared oven may perform optimal cooking profiles for a number of different foods. Yet another technical advantage is having an optimal configuration of infrared wavelength heaters for toasting and browning of food, and another optimal configuration of the infrared wavelength heaters for cooking food.

Another technical advantage is more even browning of food being toasted. Still another technical advantage is faster and more even toasting of a variety of food, e.g., different types of breads and pastries. Yet another advantage is good toast color shading on the surface while retaining a substantial portion of the moisture content of the food. Still another technical advantage is defrosting and toasting of frozen foods. Still another technical advantage is uniform toast shades over non-uniform width foods. Yet another advantage is using longer infrared wavelengths in combination with the selected browning infrared wavelengths for improving the rate of moisture evaporation of the food so as to allow even faster surface browning thereof. Other technical advantages should be apparent to one of ordinary skill in the art in view of what has been disclosed herein.

BRIEF DESCRIPTION OF THE DRAWINGS

A more complete understanding of the present disclosure and advantages thereof may be acquired by referring to the following description taken in conjunction with the accompanying drawings wherein.

Figure 1:
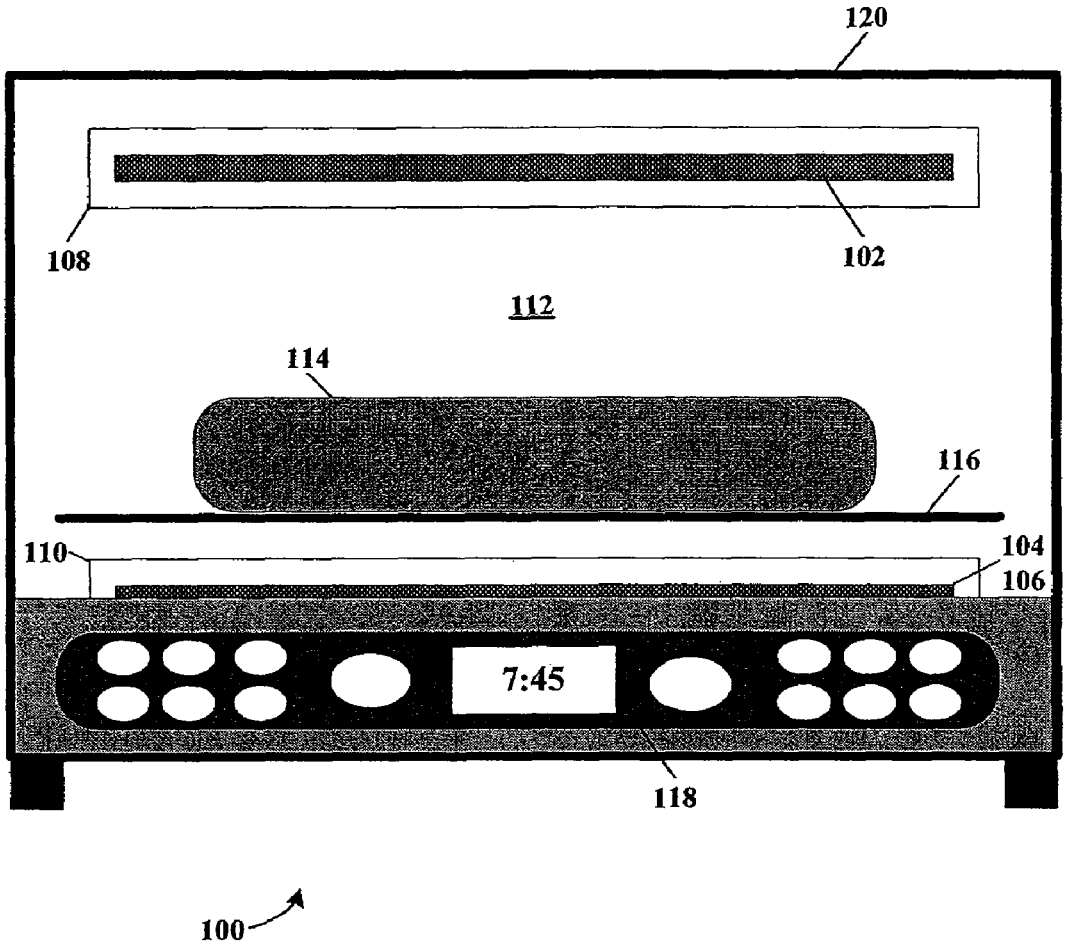
FIG. 1 is a schematic elevational front view of an infrared oven, according to an exemplary embodiment of the invention.

The invention may be susceptible to various modifications and alternative forms. Specific exemplary embodiments thereof are shown by way of example in the drawing and are described herein in detail. It should be understood, however, that the description set forth herein of specific embodiments is not intended to limit the present invention to the particular forms disclosed. Rather, all modifications, alternatives, and equivalents falling within the spirit and scope of the invention as defined by the appended claims are intended to be covered.

DETAILED DESCRIPTION OF SPECIFIC EMBODIMENTS

Referring now to the drawings, the details of exemplary embodiments of the present invention are schematically illustrated. Like elements in the drawings will be represented by like numbers, and similar elements will be represented by like numbers with a different lower case letter suffix.

Figure 2:
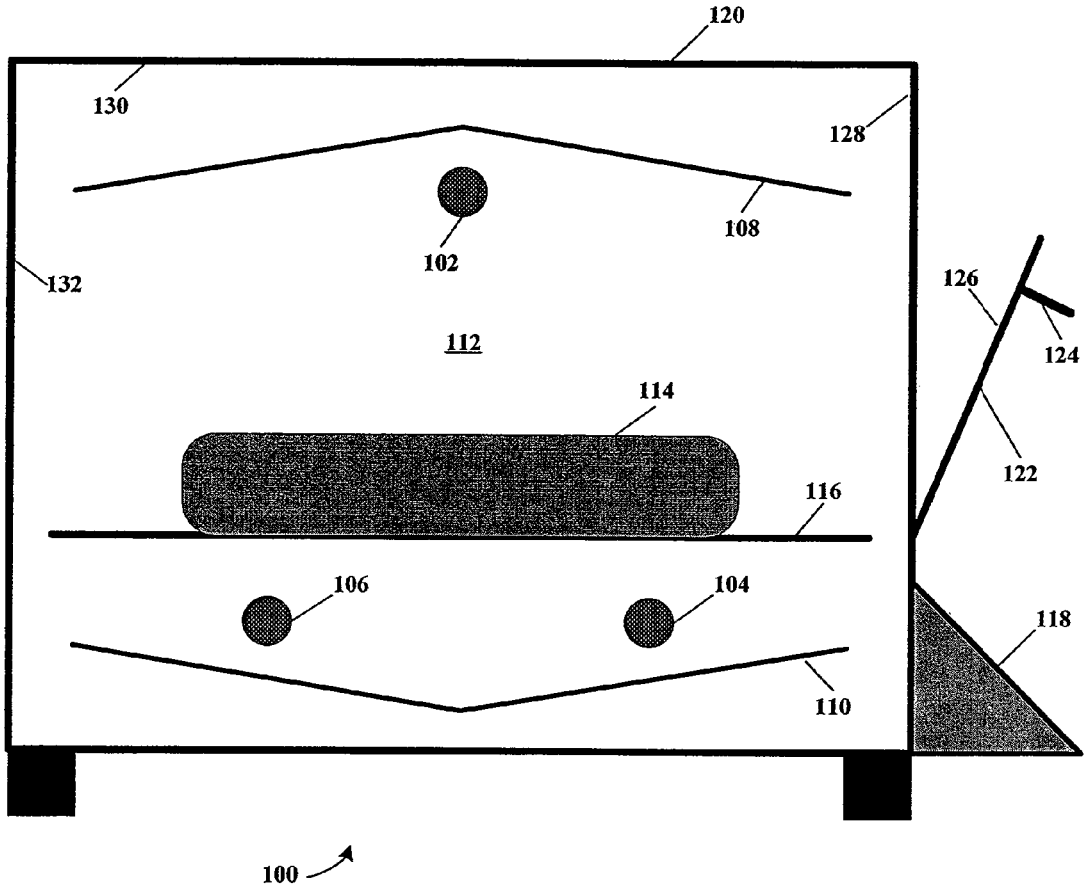
FIG. 2 is a schematic elevational side view of the infrared oven illustrated in FIG. 1.

Referring now to FIG. 1, depicted is a schematic elevational front view of an infrared oven, according to an exemplary embodiment of the invention. The infrared oven, generally represented by the numeral 100, comprises a top infrared wavelength emitting radiant heat source (hereinafter top IR heater) 102, bottom infrared wavelength emitting radiant heat sources (hereinafter bottom IR heaters) 104 and 106, top radiant heat reflector 108, bottom radiant heat reflector 110, an oven chamber 112 adapted for cooking a food 114, food tray 116, a user interface 118, and an oven housing 120. A front door 122 (FIG. 2) is attached to the oven housing 120 and is adapted to be opened and closed, for example, by a handle 124 on the front upper portion of the door 122. The inner surfaces of the oven chamber 112, e.g., front wall 128, top wall 130, rear wall 132, interior surface of the door 122, and/or combinations thereof, may be coated with suitable material, e.g., porcelain, ceramic coatings, to re-radiate IR at a desired wavelength(s), e.g., longer or shorter IR wavelength, etc., and/or to achieve a desired operating effect, e.g., a "brick oven."

The top IR heater 102 is positioned so as to emit infrared radiant heat directly onto the surface of the food located in the oven chamber 112. The top radiant heat reflector 108 is preferably designed to evenly distribute reflected infrared radiant heat energy over the food 114 from the top IR heater 102. The top IR heater 102 may comprise one or more infrared radiant heat sources. The top IR heater 102 may have a peak emission preferably at a wavelength of from about 1.63 microns to about 1.7 microns (1630-1700 nm).

The bottom IR heaters 104 and 106 are located below the food tray 116. The bottom radiant heat reflector 110 directs the infrared radiant heat energy into the food 114 from the bottom IR heaters 104 and 106. The bottom IR heaters 104 and 106 preferably emit lower infrared wavelengths for deeper penetration of food during cooking. The lower infrared wavelengths may pass through the food tray 116 and/or be reflected from the bottom radiant heat reflector 110, and/or walls of the oven enclosure 120. The bottom IR heaters 104 and 106 may have a peak emission preferably at a wavelength of from about 2.0 microns to about 2.2 microns (2000-2200 nm). The food tray 116 may be a wire screen, heat resistant glass or ceramic, a metal pan, a grilling plate having vertical ridges thereon (not shown), etc.

The top heater(s) 102 may preferably have a peak emission at a wavelength of from about 1.63 microns to about 1.7 microns (1630-1700 nm). The bottom heaters 104 and 106 preferably may have a peak emission at a wavelength of from about 2.0 microns to about 2.2 microns (2000-2200 nm).

Both the top IR heater 102 and bottom IR heaters 104 and 106 may also radiate some infrared energy at some percentage of infrared wavelengths that are lower and higher than the preferred nominal infrared wavelengths. In addition to the wavelengths of the directly emitted infrared energy, the wavelengths of the reflected infrared energy may be further elongated once they have been reflected off the walls of the oven cooking chamber 120 and the reflectors 108 and 110 therein. It is contemplated and within the scope of the invention that radiant heaters that emit longer infrared wavelengths may be incorporated for improved cooking performance when baking and broiling of foods.

The reflectors 108 and 110 are shaped so as to reflect the infrared radiant heat from the top IR heater 102 and the bottom IR heaters 104 and 106, respectively, onto the food in the oven chamber 112. The infrared radiant heat reflected from the reflectors 108 and 110 may be at a longer wavelength than the directly emitted infrared radiant heat from the top IR heater 102 and the bottom IR heaters 104 and 106, respectively. This longer wavelength infrared radiant heat penetrates deeper into the food, thus shortening the moisture evaporation time of the food before surface browning may occur. The wavelengths of infrared radiated heat may be from about 1 to about 3 microns, preferably from about 1.5 to about 2.5 microns, and most preferably at about 1.63 microns for the top IR heater 102 and about 2.11 microns for the bottom IR heaters 104 and 106.

The top IR heater 102, and bottom IR heaters 104 and 106 may be comprised of a filament (not shown) whereby electrical current is passed through the filament so as to heat the filament to a temperature at which a desired wavelength(s) of infrared energy is radiated therefrom. The top IR heater 102, and bottom IR heaters 104 and 106 may radiate a plurality of wavelengths of infrared energy as well as wavelengths of visible light. Material for and electrical current through the top IR heater 102, and bottom IR heaters 104 and 106 are selected so that the heaters produce predominantly the desired infrared wavelength or wavelengths for cooking the food. The filaments may be comprised of any type of material that can be used for resistance electric heating and is capable of emitting radiant heating energy at infrared wavelengths, e.g., metal alloy filament materials such as, for example but not limited to, Ni Fe, Ni Cr, Ni Cr Fe and Fe Cr Al, where the symbols: Ni represents nickel, Fe represents iron, Cr represents chromium, and Al represents aluminum. The filaments may be exposed or, preferably, enclosed within a high temperature infrared wavelength transparent tube, such as for example, a high temperature quartz tube (not shown). The quartz tube may be clear, chemically etched, or have extruded grooves therein depending upon the desired infrared wavelength to be emitted therethrough. Tungsten may be used for the filament when enclosed in a sealed tube. The top IR heater

102 may consume about 900 to 1000 watts of power, and the bottom IR heaters 104 and 106 may consume about 500 to 600 watts of power, for a total power consumption of approximately 1500 to 1600 watts, well within the rating of a standard 20 ampere, 120 volt wall receptacle in a home or business, e.g., kitchen receptacle. It is contemplated and within the scope of the present invention that other operating voltages and currents may be used so long as the desired infrared wavelengths of radiant heat energy are produced.

It is contemplated and within the scope of the invention that the aforementioned top IR heater may be located on one side of the food being cooked and the bottom IR heater may be located on another side of the food being cooked (not shown).

The housing 120 may be metal or non-metallic, e.g., plastic, fiberglass, etc., or some combination of both. The housing 120 is open at the front so that the food may be inserted into the oven chamber 112 when the door 122 is open. An oven control panel 118 comprises controls for the oven 100 and may be attached on or to the housing 120. A gold coating (not shown) may be applied to the quartz glass tubes for reflecting the infrared wavelength energy away from the portions of the quartz glass tubes that do not substantially contribute to the radiant heating and browning of the food. The gold coating will help in reducing the surface temperature of the housing 120. In addition, an air space between the housing 120 and the reflectors 108 and 110 also aid in reducing the surface temperature of the housing 120 during cooking of the food.

Figure 3:
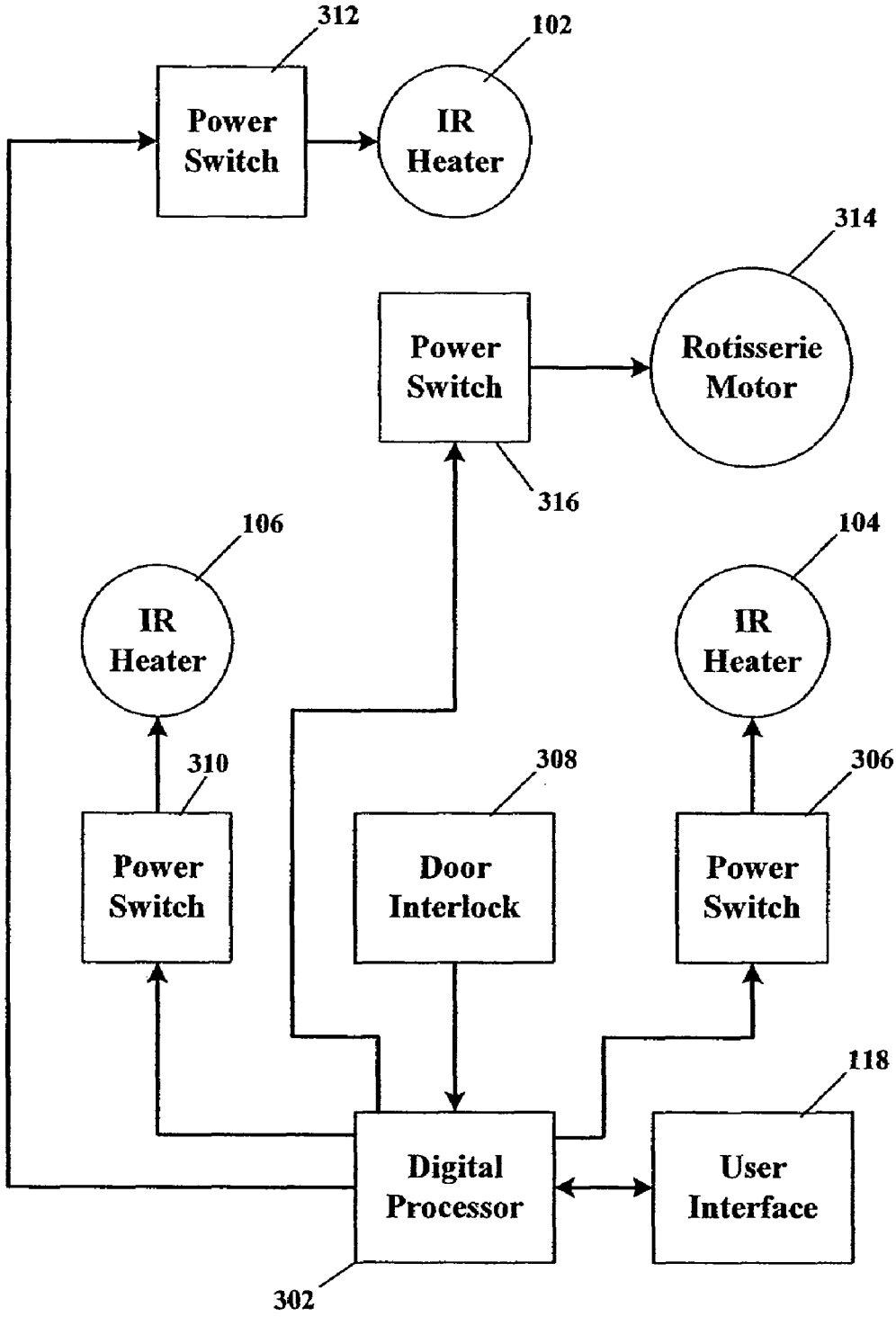
FIG. 3 is an schematic electrical block diagram of an infrared oven, according to an exemplary embodiment of the invention.

Referring now to FIG. 3, depicted is a schematic electrical block diagram of an infrared oven, according to an exemplary embodiment of the invention. Power may be applied to the top IR heater 102 through power switch 312, to the bottom IR heater 104 through power switch 306, and to the bottom IR heater 106 through power switch 310. The power switches 306, 310 and 312 may be controlled with a digital processor 302, e.g., microprocessor, microcontroller, application specific integrated circuit (ASIC), field programmable gate array (FPGA), etc. The digital processor 302 may receive input information from a door interlock 308, and the user interface 118. The door interlock 308 indicates when the door 122 is open and/or closed. The user interface 118 allows interaction with a user of the oven 100. The digital processor 302 may be programmed with predetermined routines for optimal cooking of various types of foods, e.g., steak, hamburger, pizza, pasta, dinner rolls, bread, toast, cookies, pies, turkey, chicken, pot roast, pork, tofu, meatloaf, vegetables, pastries, etc. The digital processor 302 may independently control each of the IR heaters 102, 104 and 106 for any combination of heating, cooking, browning, toasting, baking, broiling, defrosting, etc., desired. The digital processor 302 may also control a rotisserie motor 314 through a power switch 316. The rotisserie motor 316 may be controlled according to appropriate routines for rotisserie cooked foods.

Figure 4:
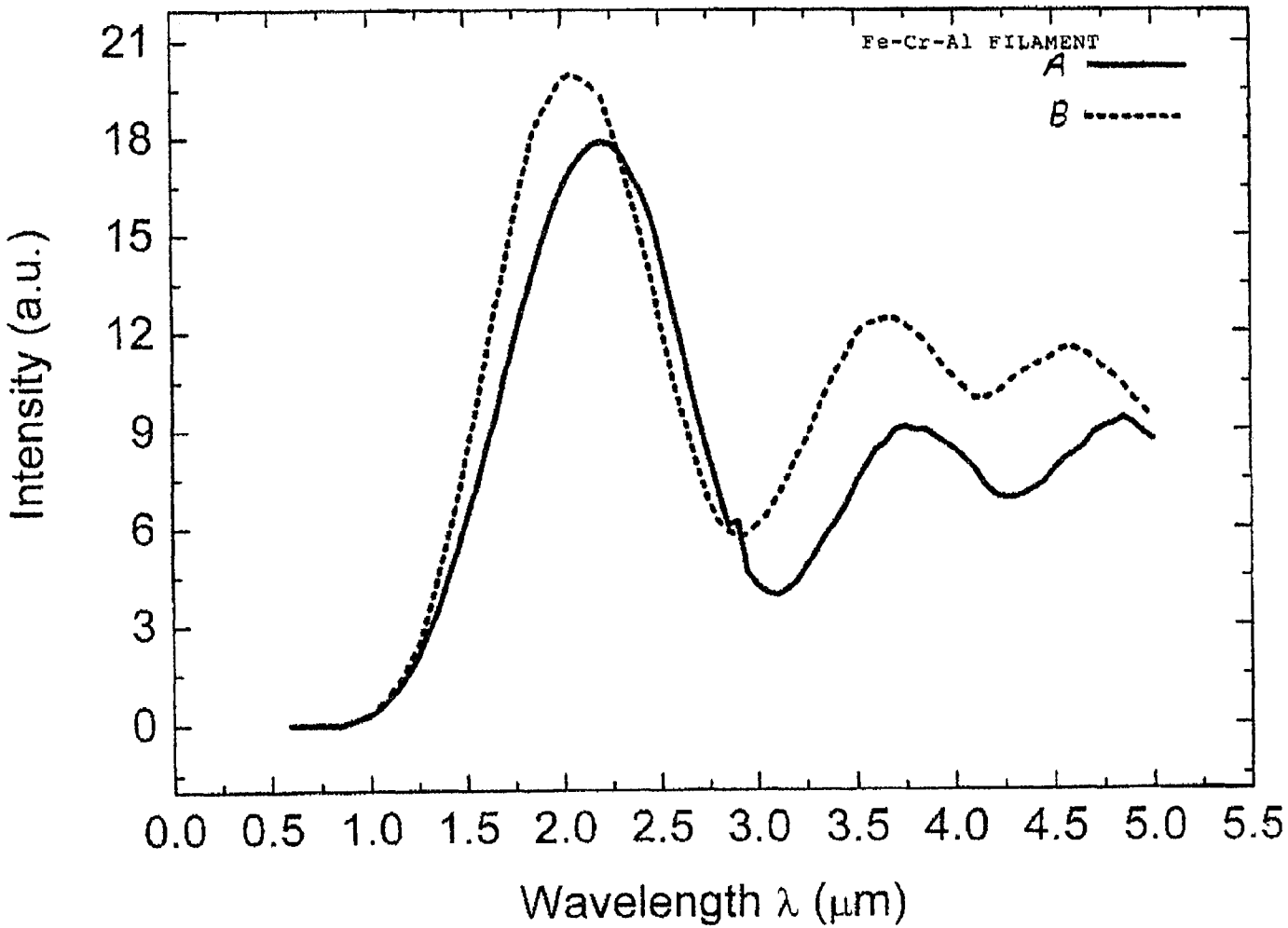
FIG. 4 is a graph of relative radiant intensity (a.u.) plotted as a function of wavelength of representative filaments that may be used for the bottom infrared heaters, according to an exemplary embodiment of the invention.

Referring to FIG. 4, depicted is a graph of relative radiant intensity (a.u.) plotted as a function of wavelength of representative filaments that may be used for the bottom infrared (IR) heaters 104 and 106, according to an exemplary embodiment of the invention. In this embodiment, the filament of each of the bottom infrared heaters 104 and 106 is preferably made of Fe Cr Al, where Fe represents iron, Cr represents chromium, and Al represents aluminum. The vertical axis of the graph depicts the relative radiant intensity (a.u.) and the horizontal axis depict the wavelength relative to the vertical axis intensity. Curve A represents a first sample of a filament tested and curve B represents a second sample of another filament tested. The curves generally indicate a peak emission at about 2 microns (2000 μm). The first and second sample filaments each drew about 250 watts of power at about 120 volts.

Figure 5:
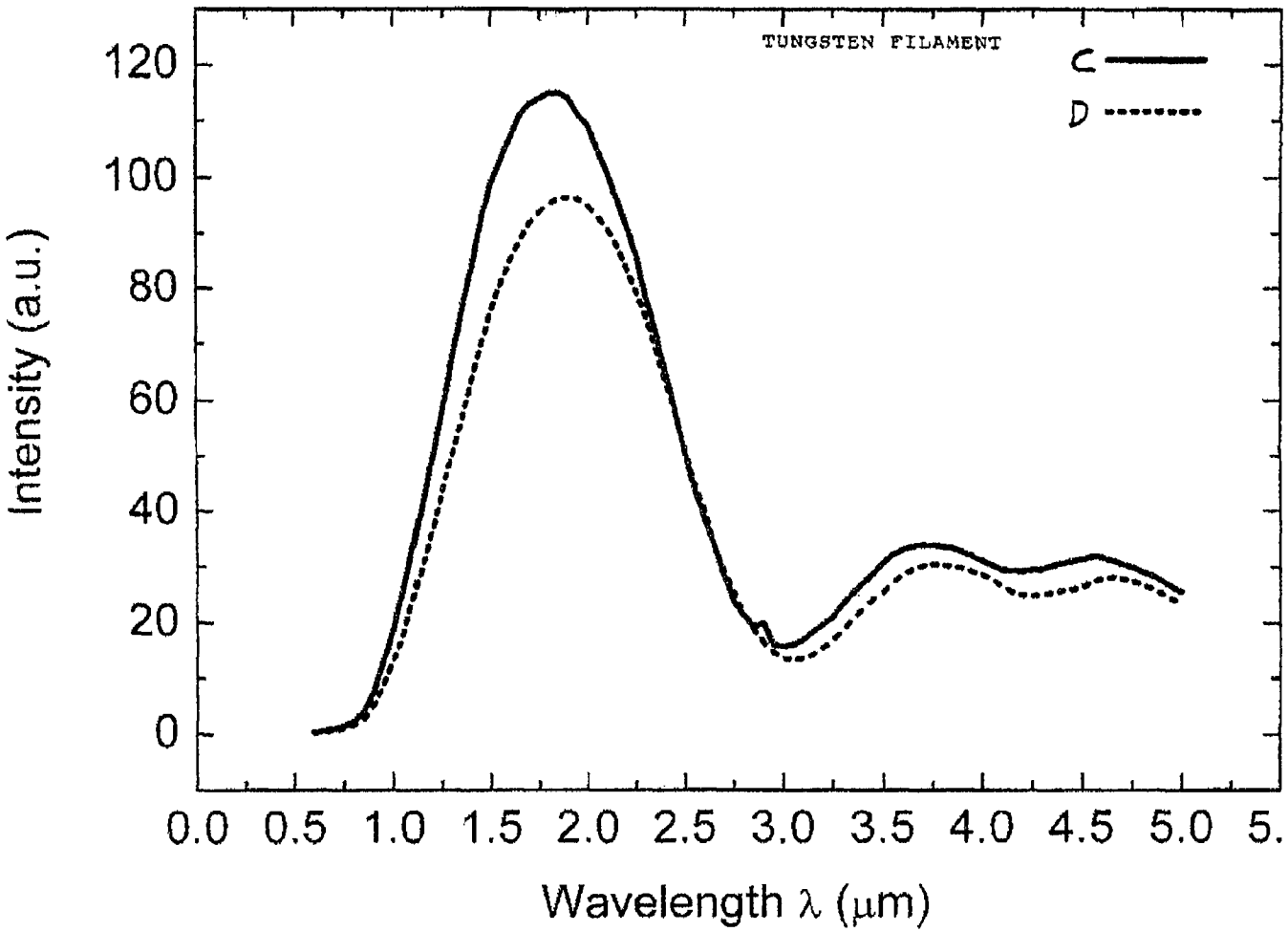
FIG. 5 is a graph of relative radiant intensity (a.u.) plotted as a function of wavelength of representative filaments that may be used for the top infrared heater, according to an exemplary embodiment of the invention.

Referring to FIG. 5, depicted is a graph of relative radiant intensity (a.u.) plotted as a function of wavelength of representative filaments that may be used for the top infrared (IR) heater 102, according to an exemplary embodiment of the invention. According to this exemplary embodiment, the filament of the top IR heater 102 is preferably made of tungsten. The vertical axis of the graph depicts the relative radiant intensity (a.u.) and the horizontal axis depict the wavelength relative to the vertical axis intensity. Curve C represents a first sample of a tungsten filament tested and curve D represents a second sample of another tungsten filament tested. The curves generally indicate a peak emission at about 1.65 microns (1650 nm). The sample tungsten filaments each drew about 1000 watts of power at about 120 volts.

The invention, therefore, is well adapted to carry out the objects and to attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method for cooking a food with infrared radiant heat, said method comprising the steps of:

cooking a food located in an oven chamber with radiant heat at a first infrared wavelength emitted from at least one first infrared heater located on one side of the food; and radiant heat at a second infrared wavelength from at least one second infrared heater located on another side of the food; wherein:

at least one of the first infrared heater and the second infrared heater comprises an electrically conductive filament inside of a quartz glass tube; and the quartz glass tube comprises at least one of:

a quartz glass tube chemically etched so as to pass at least one of the first infrared wavelength and the second infrared wavelength from the electrically conductive filament; and a quartz glass tube having extruded grooves therein so as to pass at least one of the first infrared wavelength and the second infrared wavelength from the electrically conductive filament.

2. The method of claim 1, wherein the second infrared wavelength is longer than the first infrared wavelength.

3. The method of claim 2, wherein the radiant heat at the second infrared wavelength penetrates deeper into the food than the radiant heat at the first infrared wavelength.

4. The method of claim 2, wherein the radiant heat at the second infrared wavelength evaporates the moisture from the food faster than the radiant heat at the first infrared wavelength.

5. The method of claim 2, wherein the radiant heat at the second infrared wavelength more deeply cooks the food faster than the radiant heat at the first infrared wavelength.

6. The method of claim 2, wherein the radiant heat at the first infrared wavelength browns the food surface.

7. The method of claim 1, further comprising the step of defrosting the food with the radiant heat.

8. The method of claim 1, further comprising the steps of:

reflecting radiant heat from the at least one first infrared heater onto the food with a first radiant heat reflector; and reflecting radiant heat from the at least one second infrared heater onto the food with a second radiant heat reflector.

9. The method of claim 8, wherein the infrared wavelengths of the reflected radiant heat are longer than the infrared wavelengths from the first and second infrared heaters.

10. The method of claim 1, further comprising the step of reflecting radiant heat from the radiant heat reflectors onto the food at a third and fourth plurality of infrared wavelengths.

11. The method of claim 1, further comprising the step of emitting radiant heat from the at least one first infrared heater onto the food at a first plurality of infrared wavelengths.

12. The method of claim 1, further comprising the step of emitting radiant heat from the at least one second infrared heater onto the food at a second plurality of infrared wavelengths.

13. The method of claim 1, wherein the first infrared wavelength is selected for substantially optimum browning of the food.

14. The method of claim 1, wherein the second infrared wavelength is selected for substantially optimum internal cooking of the food.

15. The method of claim 1, wherein the first infrared wavelength is from about 1 to about 3 microns.

16. The method of claim 1, wherein the first infrared wavelength is from about 1.5 to about 2.5 microns.

17. The method of claim 1, wherein the first infrared wavelength is about 1.63 microns.

18. The method of claim 1, wherein the second infrared wavelength is about 2.11 microns.

19. The method of claim 1, wherein the first infrared wavelength comprises a first plurality of infrared wavelengths.

20. The method of claim 1, wherein the second infrared wavelength comprises a second plurality of infrared wavelengths.

21. The method of claim 1, further comprising the step of providing a user interface having cooking routines stored for selection by a user when cooking a respective food.

* * * * *